US005264080A

United States Patent [19]

Shaw et al.

[11] Patent Number: 5,264,080

[45] Date of Patent: Nov. 23, 1993

[54] ARCHIVAL APERTURE CARD

[75] Inventors: Jeffry S. Shaw, Fridley, Minn.; Al Kratzer, Flemmington, N.J.; James M. Harris, Perkasie, Pa.

[73] Assignee: Minnesota Mining and Manufacturing Company, St. Paul, Minn.

[21] Appl. No.: 923,142

[22] Filed: Jul. 31, 1992

Related U.S. Application Data

[63] Continuation-in-part of Ser. No. 851,177, Mar. 13, 1992, abandoned, which is a continuation-in-part of Ser. No. 684,607, Apr. 12, 1991, abandoned.

[51] Int. Cl.[5] ..... D21H 15/00

[52] U.S. Cl. ..... 162/135; 162/141; 162/146; 162/149; 162/158; 162/175; 162/181.2

[58] Field of Search ..... 162/135, 141, 149, 185, 162/175, 146, 158, 181.2

[56] References Cited

U.S. PATENT DOCUMENTS

| | | | |
|---|---|---|---|
| 2,192,488 | 3/1940 | Reilly | 92/21 |
| 4,774,272 | 9/1988 | Lamphere et al. | 524/13 |
| 4,820,582 | 4/1989 | Merz et al. | 428/328 |
| 4,884,885 | 12/1989 | Schweinsberg | 353/120 |

FOREIGN PATENT DOCUMENTS

| | | |
|---|---|---|
| 2521258 | 11/1976 | Fed. Rep. of Germany . |
| 887914 | 7/1981 | France . |

OTHER PUBLICATIONS

Britt, Handbook of Pulp and Paper Technology (Litton Educational Publishing, Inc.), p. 46, pp. 363-365, pp. 631-641, 1970.

Canfor, Prince George Pulp and Paper, Intercontinental Pulp, 6 pages, Canada.

1989 Pulp and Pater Buyers Guide, Alkaline Papermaking, pp. 48-49, 1989.

Pfizer, Technical Data Sheet, Vicron Series (Eastern) ground limestone, 3 pages, 1989.

Anderson et al, $CaCo_3$ Fillers: selection, Use in Alkaline Papermaking Systems, Pulp and Paper Issue, pp. 82-85, Oct. 1983.

Jensen et al, Cationic Potato Starches Proven Effective as Wet End Additives, Pulp and Paper Issues, pp. 83-95, Apr. 1986.

Avebe, Production Information Sheet, Solvitose N, Ref. No.: 05.22.32.216 EF, 6 pages, Sep. 1989.

ANSI, American National Standard for Imaging Media (Film)—Silver-Gelatin Type-Specifications for Stability, IT9.1-1988, 22 pages, 1988.

ANSI, American National Standard for Imaging Media—Photographic Processed Films, Plates and Papers—Filing Enclosures and Storage Containers, IT9.2-1988, 13 pages, 1988.

Nalco, Product Bulletin, NALSIZE 7540 alkaline size, 2 pages, 1982.

Hercules, Product Data Sheet, AQUAPEL sizing agents, Number 775-3, 2 pages, 1989.

Ivanov et al, "Development of a Composition for Letterpress Paper with Improved Durability and Printability" (Abstract), *Abstract Bulleltin of the Institute of Paper Chemistry*, vol. 46, No. 10, p. 1047, Apr. 1976.

European Patent Office, European Search Report corresponding to Application No. EP 92 30 3142, 2 pages, 1992.

*Primary Examiner*—Peter Chin

*Attorney, Agent, or Firm*—Gary L. Griswold; Walter N. Kirn; William D. Bauer

[57] ABSTRACT

Archival quality aperture cards manufactured from stock formulation including:

1. between 40 and 60% southern softwood kraft pulp;
2. between 60 and 40% northern mixed hardwood pulp;
3. between 1.5 and 2.5% on total pulp, calcium carbonate for alkaline reserve;
4. between 0.05 and 1.0% on total pulp, alkyl ketene dimer as an internal sizing agent;
5. between 0.2 and 1.0% on total pulp, cationic potato starch for internal bonding improvements;
6. between 0.5 and 2.0% on total pulp, cationic potato starch as a surface sizing agent;
7. between 0.5 and 2.5% solids added to the surface sizing agent, alkyl ketene dimer as a slip agent; and
8. between 0.01 and 0.3% dyed rayon granitizing fibers.

56 Claims, 1 Drawing Sheet

ARCHIVAL APERTURE CARD

REFERENCE TO RELATED APPLICATION

This application is a continuation-in-part of application serial number 07/851,177 filed Mar. 13, 1992 now abandoned, which is a continuation-in-part of application Ser. No. 07/684,607 filed Apr. 12, 1991, and now abandoned.

BACKGROUND OF THE INVENTION

The present invention relates generally to card stock for photosensitive film mounts. In particular, the present invention is an aperture card (ie., a paper card with an opening in which a frame of film is mounted) suitable for archival storage.

Aperture cards such as that shown in FIG. 1 are commonly used for the handling and storage of photosensitive film such as microfilm frames bearing images of engineering drawings or other information. Aperture cards are typically of standard data processing punch card size, and include an aperture or hole sized to receive the microfilm frame. Strips of adhesive tape or other fasteners are used to mount the microfilm frame within the aperture or otherwise to the card.

Cameras, plotters, printers, duplicators and other types of equipment are used to process the information stored on aperture cards. Mechanical handling mechanisms drive the aperture cards within this equipment. To ensure consistent and reliable operation of the handling mechanisms, the aperture cards are manufactured to relatively strict specifications such as ANSI specification X311-1969. By way of example, some of the specifications and properties of conventional aperture cards commercially available from 3M of St. Paul, Minn., U.S.A., the assignee of the present invention, are as follows:

| PROPERTY | LIMITS |
|---|---|
| Thickness | 0.007" ± 0.004 |
| Burst (Mullen) | 55 minimum |
| Stiffness (Taber V-5) | 17.0 minimum M..<br>8.0 minimum C.D. |
| Folding Endurance (MIT) | 100 minimum M.D.<br>100 minimum C.D. |
| Tearing Resistance (Elmendorf) | 125 minimum M.D.<br>125 minimum C.D. |
| Abrasion Loss (Taber) | Top and bottom 50 maximum mg. los |
| Soothness (Sheffield) | Top and bottom 125 maximum |
| Electrical resistance | 40-250 Mohms |
| Ash | 2.0% maximum |
| Coefficient of Friction | 0.30 minimum<br>0.45 maximum<br>Kinetic friction should not vary more than 25% from static friction |
| Moisture content | 4.5% minimum<br>6.5% maximu |
| Expansion (20%-75% RH) | 0.0184" maximum length<br>0.0228" maximum width |
| Contraction (75%-20% RH) | 0.0184" maximum width<br>0.0228" maximum width |

Card stock from which the aperture cards are cut is manufactured on conventional papermaking machinery using standard formulation and papermaking techniques. The bulk of the formulation is a slurry of bleached hardwood and softwood chemical pulp, generally in a 60/40 to 80/20 hardwood to softwood ratio. Alum (Aluminum Sulfate) is added to the slurry for pH control, retention of additives such as internal sizing agents, and formation improvement. Retention and formation aids such as polyacrylamides and cationic starches can also be used. The stock is typically surface sized with starch as it is being manufactured, a step which can also have an effect on the coefficent of friction.

Information which must be retained for long periods of time is often recorded on microfilm frames mounted to aperture cards. Aperture cards used with "archival" film, that which has characteristics suitable for the preservation of records having permanent value, must meet the photographic activity test and alkali reserve test of the American National Standards Institute (ANSI) standard IT9.2-1988. Unfortunately, commercially available aperture cards of the type discussed above are somewhat acidic (pH 4.5-6.0) because of the alum used in the stock formulation, and do not meet this standard. Although paper stock with an alkali reserve is commercially available, this alkaline stock does not meet the photographic activity test and does not have the physical properties and specifications required of aperture cards.

It is evident that there is a need for "archival" aperture cards. To be suitable for archival use, the card stock must meet ANSI standard IT9.2-1988 and have the properties required of conventional aperture cards. To be commercially viable, any such archival card stock should be capable of being manufactured using conventional papermaking machinery.

SUMMARY OF THE INVENTION

The present invention is an archival photosensitive film mount stock which can be used to manufacture aperture cards having the required properties of conventional cards and also meeting the photographic activity and alkali reserve tests of ANSI standard IT9.2-1988. Conventional papermaking machinery can be used to efficiently process this formulation into the stock. The pulp base of the stock formulation is a mixture of hardwood and softwood pulp containing at least 10% softwood pulp. Alkaline earth carbonate is added in an amount that results in stock with an alkaline reserve greater than a molar equivalent of about 2% calcium carbonate, and an ash content below about 2%. Other components are added in about the following amounts:

internal sizing agent—0.05-1.0%*
cationic starch—0.2-1.0%*
surface sizing agent—0.5-2.0%*
slip agent—0.5-2.5%**

* percentage based on total pulp
** percentage solids added to surface sizing agent In one embodiment, about 2.2% calcium carbonate is used as the alkaline earth carbonate. About 0.1 alkyl ketene dimer is used as an internal sizing agent. About 0.8% cationic potato starch is used as an additive to the stock. About 1.5% of the starch is also used as the surface sizing agent. Alkyl ketene dimer is incorporated onto the surface sizing starch mixture at about 1.7% solids level for use as a slip agent. Dyed rayon fibers in the amount of about 0.01-0.3% on total pulp can be added to granitize the stock.

DETAILED DESCRIPTION OF THE PREFERRED EMBODIMENTS

Figure 1:
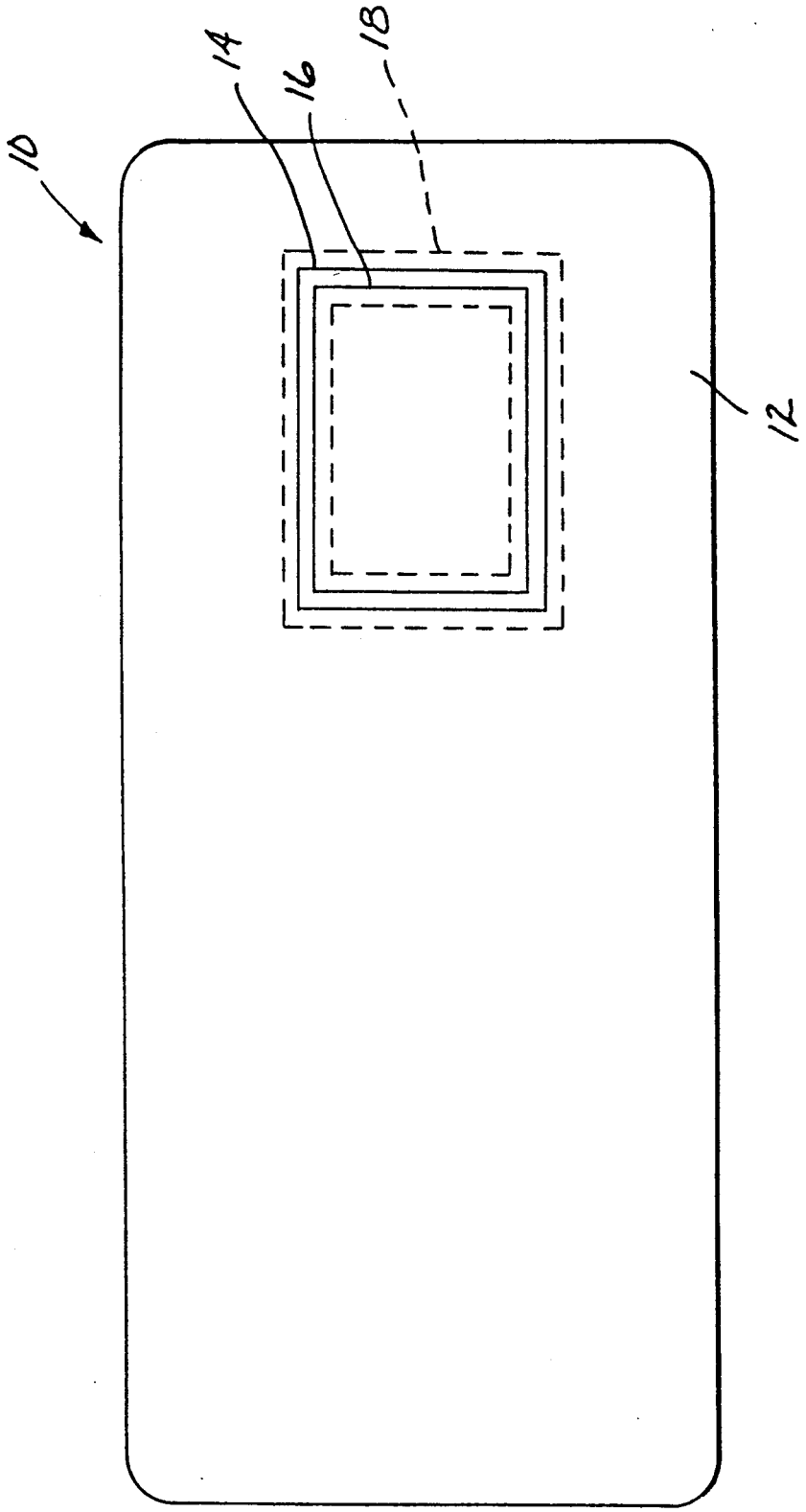
FIG. 1 is an illustration of an aperture card 10 which can be manufactured from the archival photosensitive film mount stock of the present invention. In the embodiment shown, aperture card 10 includes a card member 12 having an aperture 14 in which a frame of microfilm 16 is mounted by strips 18 of adhesive tape (shown in phantom).

The present invention is "archival" film mount stock, and aperture cards manufactured therefrom, which meet the photographic activity and alkali reserve tests of ANSI Standard IT9.2-1988. One such aperture card is shown in FIG. 1. A first embodiment of the formulation from which this archival card stock is manufactured is specified generally in the following table:

TABLE

| COMPONENT | AMOUNT | LBS/TON PULP |
|---|---|---|
| Northern Softwood Kraft Pulp | 40–60% | |
| Northern Mixed Hardwood Pulp | 60–40% | |
| Alkaline Earth Carbonate | 1.5–2.5%* | 30–50 |
| Internal Sizing Agent | 0.1–0.2%* | 2–4 |
| Cationic Starch | 0.2–0.5%* | 4–10 |
| Surface Sizing Agent | 0.1–0.2%* | 2–4 |
| Slip Agent | 0.5–1.5%** | |
| Granitizing Fibers | 0.1–0.3%* | 2–4 |

*percentages based on total pulp
**percentage solids added to size press solution The northern softwood kraft pulp is a slow growth interior northern pulp which contains mostly white spruce and lodgepole pine. Smaller amounts of interior douglas fir and balsam fir can also be included in this mixture. A blend of this type gives a good balance of strength and surface properties.

Maple, birch, and beech are the main components of the northern mixed hardwood pulp. Smaller amounts of ash, oak and aspen can also be present. This pulp imparts surface smoothness, stiffness and sheet uniformity.

The alkaline earth carbonate is calcium carbonate ($CaCO_3$), and is retained in the paper stock. This component gives the paper an "alkaline reserve" to limit destructive chemical reactions with cellulose that age papers made with acidic chemicals such as alum. The carbonate also acts as a buffer in the system. The amount added is a balance between that required to obtain sufficient alkaline reserve, while keeping the ash content of the stock within the desired range.

Alkenyl succinic anhydride (ASA) is used as an internal sizing agent in this first embodiment to impart liquid water resistance throughout the stock. Cationic starch (e.g., potato) helps retain the anionic calcium carbonate and the ASA sizing in the stock and improves bonding of the pulp fibers. Cationic potato starch is also used as a surface sizing agent, and imparts some additional water resistance on the surface of the stock while improving surface strength (no fiber picking) and printing quality (no feathering).

A controlled amount of alkyl ketene dimer (AKD) is used as a slip agent to achieve the surface coefficient of friction. This chemical is incorporated into the surface sizing mixture in a size press at about 1.0% solids level in this first embodiment. The actual amount is determined by the resulting coefficient of friction and adjusted accordingly.

Fibers such as dyed rayon fibers can be added to the formulation to granitize the paper. The amount of granitizing fibers added is determined by the desired visual appearance of the stock. Dyes can also be added as desired to alter the color of the stock.

The formulation described above can be processed on conventional papermaking machinery using standard stock preparation and papermaking techniques. The hardwood and softwood pulps are blended together with the granitizing fibers and slurried until dispersed. Alkaline earth carbonate is added to the slurry during the mixing process. The components in the slurry are then refined to prepare the fibers for papermaking. To balance the strength and dimensional stability requirements for aperture card stock, the pulp mixture is lightly refined (prior to sheet formation) to a level between 480 and 600 CSF(Canadian Standard Freeness), and preferably to a level around 540 CSF. Refining to a greater extent (lower freeness) improves strength properties such as burst, tensile and fold, as well as surface smoothness. However, this greater refining has a negative effect on the dimensional stability because the refining increases the bonding level of the network causing the resulting card to react more dramatically to moisture changes. Decreasing the level of refining results in a sheet with better dimensional stability but less overall strength.

The internal sizing agent and cationic starch are blended into the pulp just prior to sheet formation. In one embodiment, the sheet is formed on a fourdrinier machine using a dandy roll to improve overall formation. However, other types and configurations of papermaking machinery could be used as well. As the sheet is being dried, the surface sizing agent is combined with the slip agent and added at the size press in a conventional manner. The sheet is calendered to the proper thickness and surface finish.

One formulation of commercially available components is given below. Tests performed on these components, both singularly and in combination before and after sheet formation, have shown that the resulting aperture card stock has the archival characteristics required by ANSI Standard IT9.2 - 1988, as well as other properties of conventional aperture cards.

EXAMPLE

| COMPONENT | MANUFACTURER | AMOUNT | LBS #/ TON |
|---|---|---|---|
| PRINCE GEORGE softwood pulp | Canfor | 50% | |
| BURGESS hardwood pulp | James River | 50% | |
| VICRON 15—15 size alkaline earth carbonate | Pfizer | 2.2%* | 44 |
| NALCO NALSIZE 7540 internal sizing agent | Nalco | 0.15%* | 3 |
| SOLVITOSE N | Avebe | 0.3%* | 6 |

-continued

| COMPONENT | MANUFACTURER | AMOUNT | LBS #/ TON |
|---|---|---|---|
| cationic starch | | | |
| SOLVITOSE N cationic starch | Avebe | 0.15%* | 3 |
| surface sizing agent | | | |
| AQUAPEL L-360XC | Hercules | 1.0%** | |
| slip agent | | | |
| VERTIPILE dyed rayon fibers | James River-Curtis Division | 0.125%* | 2.25 |

*percentages based on total pulp
**percetages solids added to size press solution In a second embodiment, the formulation from which the archival card stock is manufactured includes a hardwood and softwood pulp mixture containing at least 10% softwood pulp. A pulp base containing any less softwood pulp would likely exhibit lower strength properties. Beyond this criterion, the relative amounts of hardwood and softwood pulp can be optimized, depending on the characteristics of the particular varieties selected, to achieve the desired balance of strength and surface properties.

The amount of alkaline earth carbonate (e.g., the Vicron 15—15 calcium carbonate) should be capable of imparting an alkaline reserve of greater than a molar equivalent of about 2% calcium carbonate. However, the amount of calcium carbonate added for this purpose should produce finished stock having an ash content within desired specifications (e.g., a maximum of 2.0%). Calcium carbonate in an amount of about 1.0% to 2.5% (about 2.2in one embodiment) on total pulp will generally meet these requirements.

The amount of internal sizing agent included in the formulation (e.g., Nalco Nalsize 7540 alkenyl succinic anhydride) is between about 0.05 and 1.00% (about 0.15% in one embodiment) on total pulp. The amount of cationic starch included in the formulation (e.g., Avebe Solvitose N cationic potato starch) is between about 0.and 1.5% (about 0.7% in one embodiment) on total pulp. The amount of surface sizing agent included in the formulation (e.g., Avebe Solvitose N cationic starch) is between about 0.05 and 2.00% on total pulp, depending on the amount of internal sizing agent added. Generally, the more internal sizing agent that is added to the formulation, the less surface sizing agent that will be needed to obtain the desired properties (e.g., to limit feathering). About 1.0% surface sizing agent should provide desired results. The formulation for this second embodiment also includes slip agent, in the amount of about 0.5 to 1.5% (about 1.0% in one embodiment) solids added to the surface sizing agent. Granitizing fibers in an amount of about 0.0to 0.30% on total pulp will provide an appropriate appearance to the finished stock.

In yet a third and preferred embodiment, the formulation from which the archival card stock is manufactured includes a hardwood and softwood pulp mixture containing at least 10%, and preferably about 50%, southern softwood kraft pulp. About 50% northern mixed hardwood pulp is used in this preferred embodiment.

The amount of alkaline earth carbonate (e.g., Vicron 15—15 calcium carbonate) should be capable of imparting an alkaline reserve of greater than a molar equivalent of about 2% calcium carbonate. However, the amount of calcium carbonate added for this purpose should produce finished stock having an ash content within desired specifications (e.g., a maximum of about 2.0%). Calcium carbonate in an amount of about 1.0% to 2.5% (about 2.2% in preferred embodiment) on total pulp will generally meet these requirements.

Alkyl ketene dimer (AKD) is used as an internal sizing agent in this preferred embodiment. AKD has moderate reactivity compared to the fast reaction rate of ASA. As a result, final cure levels are achieved at different times, thus allowing a greater amount of the size press mixture to be picked up using AKD before the final sizing level is achieved. Using this means of control, the final sheet properties can be achieved within a larger window of operation. The AKD is also relatively easy to use and control since it can be metered directly into the stock along with the cationic starch, unlike ASA which must be emulsified first and used shortly thereafter because of its reactivity. The amount of internal AKD sizing agent including in formulation of this preferred embodiment (e.g., Aquapel L-360XC) is between about 0.05 and 1.0% (about 0.1% in one preferred embodiment) on total pulp.

The amount of cationic starch included in the formulation (e.g., a Avebe Solvitose N cationic potato starch) is between about 0.2 and 1.0% (about 0.8% in one preferred embodiment) on total pulp. The amount of surface sizing agent included in the formulation (e.g., Avebe Solvitose N cationic starch) is between about 0.5 and 2.0% on total pulp, depending on the amount of internal sizing agent added. About 1.5% surface sizing agent as provided desired results in this preferred embodiment.

The formulation for the third embodiment also includes slip agent (e.g., Aquapel L-360XC) in the amount of about 0.5 to 2.5% (about 1.7% in the preferred embodiment) solids added to the surface sizing agent. Granitizing fibers in an amount of about 0.01 to 0.30% on total pulp will provide an appropriate appearance to the finished stock.

Although the present invention has been described with reference to the preferred embodiments those skilled in the art will recognize that changes made be made in form and detail without departing from the spirit and scope of the invention. For example, the ratio of softwood to hardwood can be varied depending upon the characteristics of the types of pulp used.

What is claimed is:

1. Archival film mount stock manufactured from a formulation including:

between 40 and 60% softwood pulp;

between 60 and 40% hardwood pulp;

between 1.5 and 2.5% on total pulp, alkaline earth carbonate;

between 0.1 and 0.2% on total pulp, internal sizing agent;

between 0.2 and 0.5% on total pulp, cationic starch;

between 0.1 and 0.2% on total pulp, surface sizing agent; and between 0.5 and 1.5% solids added to the surface sizing agent, of a slip agent.

2. The film mount stock of claim 1 wherein the formulation further includes between 0.1 and 0.3% on total pulp, granitizing fiber

3. The film mount stock of claim 1 wherein the softwood pulp in the formulation includes northern softwood kraft pulp.

4. The film mount stock of claim 3 wherein the softwood pulp in the formulation includes about 50% northern softwood kraft pulp.

5. The film mount stock of claim 1 wherein the hardwood pulp in the formulation includes northern mixed hardwood pulp.

6. The film mount stock of claim 5 wherein the hardwood pulp in the formulation includes 50% northern mixed hardwood pulp.

7. The film mount stock of claim 1 wherein the alkaline earth carbonate in the formulation include calcium carbonate.

8. The film mount stock of claim 7 wherein the alkaline earth carbonate in the formulation includes about 2.2% fine-ground calcium carbonate.

9. The film mount stock of claim 1 wherein the internal sizing agent in the formulation includes alkenyl succinic anhydride.

10. The film mount stock of claim 9 wherein the internal sizing agent in the .formulation includes about 0.15% alkenyl succinic anhydride.

11. The film mount stock of claim 1 wherein the cationic starch in the formulation includes cationic potato starch.

12. The film mount stock of claim 11 wherein the cationic starch in the formulation includes about 0.3% cationic potato starch.

13. The film mount stock of claim 1 wherein the surface sizing agent in the formulation includes cationic potato starch.

14. The film mount stock of claim 13 wherein the surface sizing agent in the formulation includes about 0.15% cationic potato starch.

15. The film mount stock of claim 1 wherein the slip agent in the formulation includes alkyl ketene dimer.

16. The film mount stock of claim 15 wherein the slip agent in the formulation includes about 1.0% solids level alkyl ketene dimer in the surface sizing agent.

17. Archival film mount stock manufactured from a formulation including:

between 40 and 60% northern softwood kraft pulp;

between 60 and 40% northern mixed hardwood pulp;

between 1.5 and 2.5% on total pulp, calcium carbonate;

between 0.1 and 0.2% total pulp, alkenyl succinic anhydride;

between 0.2 and 0.5% on total pulp, cationic potato starch;

between 0.1 and 0.2% on total pulp, cationic potato starch as a surface sizing agent; and between 0.5 and 1.5% solids in the surface sizing agent, alkyl ketene dimer as a slip agent.

18. The film mount stock of claim 17 wherein the formulation further includes between 0.and .3% on total pulp, granitizing fiber.

19. Archival film mount stock manufactured from a formulation including:

a mixture of hardwood pulp and softwood pulp containing at east 10% softwood pulp;

an amount of alkalne earth carbonate which provides the stock with an alkaline reserve greater than a molar equivalent of about 2% calcium carbonate, and an ash content below bout 2%;

between about 0.05 and 1.00% on total pulp, internal sizing agent;

between about 0.1 and 1.5% on total pulp, cationic starch;

between about 0.05 and 2.00% on total pulp, surface sizing agent; and between about 0.5 and 1.5% solids added to the surface sizing agent, of a slip agent.

20. The film mount stock of claim 19 wherein the formulation further includes between about 0.01 and 0.30% on total pulp, granitizing fibers.

21. The film mount stock of claim 19 wherein the softwood pulp includes softwood kraft pulp.

22. The film mount stock of claim 2 wherein the softwood pulp in the formulation includes about 50% softwood kraft pulp.

23. The film mount stock of claim 19 wherein the hardwood pulp in the formulation includes mixed hardwood pulp.

24. The film mount stock of claim 23 wherein the hardwood pulp in the formulation includes about 50% mixed hardwood pulp.

25. The film mount stock of claim 19 wherein the alkaline earth carbonate in the formulation includes calcium carbonate.

26. The film mount stock of claim 25 wherein the alkaline earth carbonate in the formulation includes about 2%, on total pulp, fine-ground calcium carbonate.

27. The film mount stock of claim 19 wherein the internal sizing agent includes alkenyl succinic anhydride.

28. The film mount stock of claim 27 wherein the internal sizing agent in the formulation includes about 0.15% alkenyl succinic anhydride.

29. The film mount stock of claim 19 wherein the cationic starch in the formulation includes cationic potato starch.

30. The film mount stock of claim 29 wherein the cationic starch in the formulation includes about 0.7% cationic potato starch.

31. The film mount stock of claim 19 wherein the surface sizing agent in the formulation includes cationic potato starch.

32. The film mount stock of claim 31 wherein the surface sizing agent in the formulation includes about 1.0% cationic potato starch.

33. The film mount stock of claim 19 wherein the slip agent in the formulation includes alkyl ketene dimer.

34. The film mount stock of claim 33 wherein the slip agent in the formulation includes about 1.0% solids level alkyl ketene dimer in the surface sizing agent.

35. The film mount stock of claim 19 where in the alkaline earth carbonate in the formulation includes between about 1.0 and 2.5% alkaline earth carbonate on total pulp.

36. Archival film mount stock manufactured from a formulation including:

a mixture of hardwood pulp and softwood pulp containing at least 10% softwood pulp;

between about 1.5 and 2.5% on total pulp, calcium carbonate;

between about 0.05 and 0.20% on total pulp, alkenyl succinc anhydride;

between about 0.2 and 1.0% on total pulp, cationic potato starch;

between about 0.1 and 1.0% on total pulp, cationic potato starch as a surface sizing agent; and between about 0.5 and 1.5% solids in the surface sizing agent, alkyl ketene dimer as a slip agent.

37. The film mount stock of claim 36 wherein the formulation further includes between about 0.01 and 0.3% on total pulp, granitizing fibers.

38. Archival film mount stock manufactured from a formulation including:

a mixture of hardwood pulp and softwood pulp containing at least 10% softwood pulp;

an amount of alkalne earth carbonate which provides the stock with an alkaline reserve greater than a molar equivalent of about 2% calcium carbonate, and an ash content below about 2%;

between about 0.05 and 1.0% on total pulp, internal sizing agent;

between about 0.2 and 1.0% on total pulp, cationic starch;

between about 0.5 and 2.0% on total pulp, surface sizing agent; and between about 0.5 and 2.5% solids added to the surface sizing agent, of a slip agent.

39. The film mount stock of claim 38 wherein the formulation further includes between about 0.0and 0.30% on total pulp, granitizing fibers.

40. The film mount stock of claim 38 wherein the softwood pulp includes softwood kraft pulp.

41. The film mount stock of claim 40 wherein the softwood pulp in the formulation includes about 50% southern softwood kraft pulp.

42. The film mount stock of claim 38 wherein the hardwood pulp in the formulation includes mixed hardwood pulp.

43. The film mount stock of claim 42 wherein the hardwood pulp in the formulation includes about 50% mixed hardwood pulp.

44. The film mount stock of claim 38 wherein the alkaline earth carbonate in the formulation includes calcium carbonate.

45. The film mount stock of claim 44 wherein the alkaline earth carbonate in the formulation includes about 2%, on total pulp, fine-ground calcium carbonate.

46. The film mount stock of claim 38 wherein the internal sizing agent include alkyl ketene dimer.

47. The film mount stock of claim 46 wherein the internal sizing agent in the formulation includes about 0.1% alkyl ketene dimer.

48. The film mount stock of claim 38 wherein the cationic starch in the formulation includes cationic potato starch.

49. The film mount stock of claim 48 wherein the cationic starch in the formulation includes about 0.8% cationic potato starch.

50. The film mount stock of claim 38 wherein the surface sizing agent in the formulation includes cationic potato starch.

51. The film mount stock of claim 50 wherein the surface sizing agent in the formulation includes about cationic potato starch.

52. The film mount stock of claim 38 wherein the slip agent in the formulation includes alkyl ketene dimer.

53. The film mount stock of claim 52 wherein the slip agent in the formulation includes about 1.7% solids level alkyl ketene dimer in the surface sizing agent.

54. The film mount stock of claim 38 where in the alkaline earth carbonate in the formulation includes between about 1.0 and 2.5% alkaline earth carbonate on total pulp.

55. Archival film mount stock manufactured from a formulation including:

a mixture of hardwood pulp and softwood pulp containing at least 10% softwood pulp;

between about 1.5 and 2.5% on total pulp, calcium carbonate;

between about 0.05 and 1.0% on total pulp, alkyl ketene dimer;

between 0.2 and 1.0% on total pulp, cationic potato starch;

between about 0.5 and 2.0% on total pulp, cationic potato starch as a surface sizing agent; and between about 0.5 and 2.5% solids in the surface sizing agent, alkyl ketene dimer as a slip agent.

56. The film mount stock of claim 55 wherein the formulation further includes between about 0.01 and 0.3% on total pulp, granitizing fibers.

* * * * *

UNITED STATES PATENT AND TRADEMARK OFFICE

CERTIFICATE OF CORRECTION

PATENT NO. : 5,264,080

DATED : November 23, 1993

INVENTOR(S) : Shaw et al.

It is certified that error appears in the above-indentified patent and that said Letters Patent is hereby corrected as shown below:

Column 1, line 42, delete "17.0 minimum M.." and insert --17.0 minimum M.D.--.

Column 1, line 49, delete "Soothness" and insert --Smoothness--.

Column 1, line 50, delete "MOHMS" and insert --M OHMS--.

Column 1, line 58, delete "maximu" and insert --maximum--.

Column 1, line 63, delete "width" and insert --length--.

UNITED STATES PATENT AND TRADEMARK OFFICE

CERTIFICATE OF CORRECTION

PATENT NO. : 5,264,080

DATED : November 23, 1993

INVENTOR(S) : Shaw et al.

It is certified that error appears in the above-indentified patent and that said Letters Patent is hereby corrected as shown below:

Column 5, line 36, delete "2.2in" and insert --2.2% in--.

Column 5, line 44, delete "0." and insert --0.1--.

Column 5, line 57, delete "0.0to" and insert --0.01 to--.

Column 7, line 11, delete "include" and insert --includes--.

Column 7, line 55, delete "0.and" and insert --0.1 and--.

UNITED STATES PATENT AND TRADEMARK OFFICE

CERTIFICATE OF CORRECTION

PATENT NO. : 5,264,080

DATED : November 23, 1993

INVENTOR(S) : Shaw et al.

It is certified that error appears in the above-indentified patent and that said Letters Patent is hereby corrected as shown below:

Column 8, line 10, delete "2" and insert --21--.

Column 9, line 20, delete "0.0and" and insert --0.01 and--.

Column 9, line 42, delete "include" and insert --includes--.

Column 10, line 15, after the word "about" and before the word "cationic", insert --1.5%--.

Signed and Sealed this

Twenty-seventh Day of September, 1994

*Attest:*

Bruce Lehman

BRUCE LEHMAN

*Attesting Officer*

*Commissioner of Patents and Trademarks*